United States Patent [19]

Driskill

[11] Patent Number: 4,962,778

[45] Date of Patent: Oct. 16, 1990

[54] BACKWASHING DISPENSER FOR AIR CONDITIONER DRAIN PANS

[76] Inventor: Brent J. Driskill, 1900 Bonnie, Metairie, La. 70001

[21] Appl. No.: 320,275

[22] Filed: Mar. 7, 1989

[51] Int. Cl.[5] ..... B08B 3/02

[52] U.S. Cl. ..... 134/169 C; 134/195; 134/201

[58] Field of Search ..... 134/104.3, 166 R, 166 C, 134/169 R, 169 C, 195, 201; 137/132

[56] References Cited

U.S. PATENT DOCUMENTS

| | | | |
|---|---|---|---|
| 2,009,955 | 7/1935 | Burns | 134/169 R |
| 4,180,091 | 12/1975 | Hanley et al. | 134/169 C X |
| 4,527,585 | 7/1985 | Mirabile | 134/169 C |
| 4,537,490 | 3/1986 | Kaletsky | 134/166 R X |
| 4,667,691 | 5/1987 | Sasa | 134/169 C |
| 4,682,623 | 7/1987 | Scherer | 134/166 C |
| 4,828,625 | 5/1989 | Moran | 134/169 R X |

FOREIGN PATENT DOCUMENTS

| | | | |
|---|---|---|---|
| 240482 | 1/1969 | U.S.S.R. | 134/169 C |

*Primary Examiner*—Frankie L. Stinson

*Attorney, Agent, or Firm*—Pravel, Gambrell, Hewitt, Kimball & Krieger

[57] ABSTRACT

A mechanical/chemical cleaning apparatus for clearing air conditioner reservoir or a drain pan flow lines of algae and other solid material includes a special fitting with an internal flexible conduit which can extend or retract within the drain line for mechanically/chemically treating the flow line to remove solid material therefrom.

10 Claims, 1 Drawing Sheet

BACKWASHING DISPENSER FOR AIR CONDITIONER DRAIN PANS

BACKGROUND OF THE INVENTION

1. Field of the Invention

The present invention relates to central air conditioners and more particularly relates to a method and apparatus for removing blockage in the condensate drain line of central air conditioners typically clogged by algae, sludge, slime and the like by using a combination of mechanical and chemical cleaning applied through a backwash fitting apparatus.

2. General Background

Many modern homes, office buildings, apartments, etc. are heated and cooled using a central air conditioning system. These air conditioning systems are typically mounted in the attic or closet enclosure of the home because of the availability of space. Because of the nature of these central air conditioning units, they require a reservoir section for catching condensate water which is generated on a constant flow basis while the unit is in operation. Some of the water drains from the reservoir through a provided drain line to the sewer or to the exterior of the home. However, there is typically a residue of water which remains in the reservoir at all times. This residual water can become contaminated and harbor algae, fungi, sludge, and the like. Over a period of time, this material accumulates in ever increasing amounts and eventually a blockage can occur which prevents normal and routine drainage of the reservoir through the drain line. This problem can be dangerous to the home because if not remedied, the reservoir can overflow allowing water to inundate the attic or closet area beside and around the air conditioning unit, with water saturation and possibly extensive damage to the ceiling and walls.

The constant problem of drain stoppage in the central air conditioning units has thus been a major problem since their inception. Several different approaches to solving this continuing occurrence have been cumbersome and costly. Most of the solutions have been primitive and manual, being labor intensive and expensive for the home owner. Unfortunately, proper maintenance of the essential air conditioning unit requires mechanical knowledge of the cooling coil section (evaporator coil) and its connecting drain system. With proper tools, one can dismantle the service panels to access the drain pan or reservoir section and pour a chemical solution or place solvable tablets into the drain pan or reservoir system. Such chemical action will eventually clear or dissolve dirt particles while killing algae and other forms of growth that will eventually clog the drain line.

However, the average home owner does not have the knowledge the skills nor the tools to properly treat his or her central air conditioning unit in this fashion. The inactment of a periodic program of chemical/mechanical injection into the drain line system would either greatly reduce or eliminate the problem of reservoir or drain pan overflow thus decreasing the chance that substantial damage will occur to the home at the ceiling, carpet, wall, or other areas which are susceptible to substantial damage because of water. Several patents have issued which relate to backwashing, drain line cleaning, and methods of treating vessels to prevent blockage.

U.S. Pat. No. 2,013,518 issued to Linde entitled "Air Washer And Sterilizer" discloses a tank system with backwash capability.

U.S. Pat. No. 3,197,272 issued to Regutti entitled "Method Of Treating Cooling Towers", a treatment method uses chemical steam distillable biocides to destroy fungi and other organisms.

U.S. Pat. No. 3,823,427 issued to Pittet entitled "Aerosol Hydraulic Drain Opener" provides an apparatus for clearing waste stoppage from conduits such as pipes and drains. The device employs a hydraulic ram wherein a column of water or other liquid is used as a flexible shaft between the aerosol drain opener and the stoppage or obstruction. The device employed is an aerosol can capable of withstanding at least 72 psig. at 70°.

U.S. Pat. No. 4,309,365 issued to Van Ness et al. discloses an evaporative cooler body comprising a non-corrosive, insulative assembly of self locating, self-jigging parts. Stand-offs are provided for increasing the effective area of the evaporative cooling pads and for improving air flow across the surface of and through the pads. A water distribution system permits sheeting of the water across the top surfaces of the evaporative cooling pads to obtain a more uniform distribution of water within said pads. Means are provided for interrupting water flow on the surface of the evaporative cooling pads and returning such water to the interior of said pad so as to increase the overall efficiency of the evaporative cooler. The evaporative cooler cabinet is comprised of a minimal number of reaction injection molded elements of high modulus urethane elastomer. The material insulates both sound and heat providing a quieter running and more cooling efficient device. Color may be permanently molded into the cabinet. The cabinet will not rust, chip, corrode or fade. Precision molding of the elements permits the cabinet to be assembled readily without the need for welding, rivets, screw fasteners or the like since the precision fit of parts makes the assembly a self-jigging one.

U.S. Pat. No. 4,426,003 entitled "Drain Cleaner Package" provides a drain cleaner package which reduces the hazards of handling a caustic material, such as sulfuric acid, or an aqueous alkali metal hydroxide solution in a container by providing a layer of immiscible liquid in the container above the caustic material. In a preferred embodiment the container is a bottle with a narrowed neck.

U.S. Pat. No. 4,476,066 entitled "Joint Assembly For Casing Cells" provides a joint assembly for a casing cell or the like, which may form the housing of an air-conditioning appliance serves to attach a plurality of wall members to respective adjacent wall members abutting with abutting faces inclined to the main surface of each wall member wherein the tongue type elements positively engage the groove type elements provided in at least one of the abutting faces and defining an undercut edge for the tongue elements, and two of the wall members of the casing cell which are arranged opposite and rigidly connected to each other and receive the other moveable wall members by insertion in a rectilinear direction essentially perpendicular to an opening face defined between the rigidly connected wall members at least one of the joining elements being resiliently deformable.

SUMMARY OF THE PRESENT INVENTION

An air conditioner drain line and drain pan cleaner kit apparatus includes a drain outlet structure for draining accumulated fluid from the pan of an air conditioner reservoir and includes a drain flow line with a drain line bore for transmitting such fluid to a desired remote discharge point. The drain outlet structure includes a fitting body positioned during use in the drain flow line and adjacent the air conditioner drain pan, the fitting having a fitting bore communicating with the drain line bore. A fitting port extends both internally and externally of the fitting body communicating with the flow bore. A flexible flush line conduit comprises an elongated tubular member with a tube lumen form conveying flow and connected during use to the fitting port extending therethrough, the tubular member having an external diameter equal to or smaller than the internal diameter of the drain line bore and equal to or larger than the fitting port. The flush line conduit forms a slideable connection with the fitting port in a seal therewith so that excess of fluid will not leak from the fitting port during use, and the flush line defines an acute angle with drain line bore axis at the fitting outlet. The flush line extendable between the fitting and a position at least adjacent the drain outlet so that the flush line or fluid dispensed therefrom can mechanically break up solid material clogging the drain outlet structure. A pump is provided for pumping a cleaning fluid into the flush line and drain line bore.

In the preferred embodiment, the pump is manually operable and can include a squeeze bottle or lever operable manual pump construction.

In the preferred embodiment, the flush line has a collapsible sidewall.

In the preferred embodiment, the flush line is a soft pliable material with a collapsible wall. The fitting can includes a lateral opening defining a cleanout for access in the fitting bore.

In the preferred embodiment, the fitting body is generally tee shaped. The fitting outlet preferably defines an angle of between twenty and seventy-five degrees (20°–75°) with the fitting flow bore in longitudinal axis.

A second flush line communicating with the first flush line upstream of the fitting body can be provided for bypassing the outlet structure and dispensing cleaning fluid to the drain pan directly at a position in the drain pan upstream of the outlet structure.

BRIEF DESCRIPTION OF THE DRAWING

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
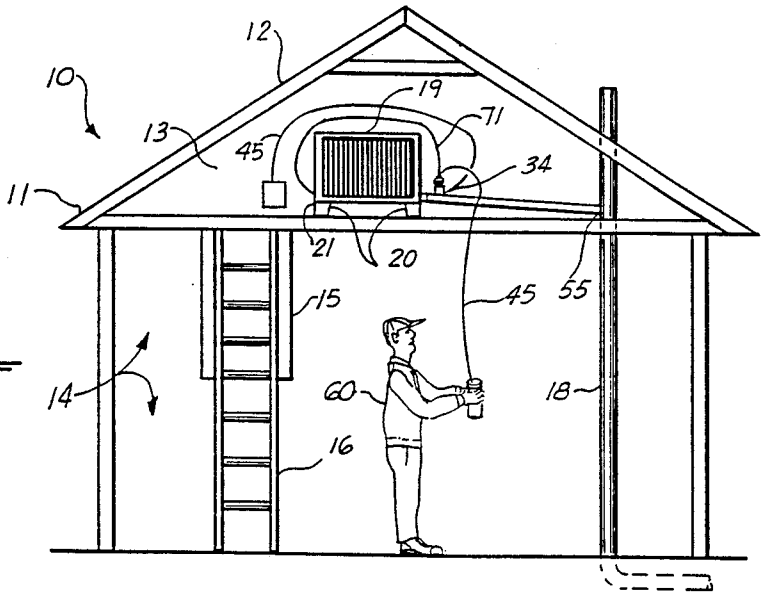
FIG. 1 is a schematic elevational view of the preferred embodiment of the apparatus of the present invention.
Figure 2:
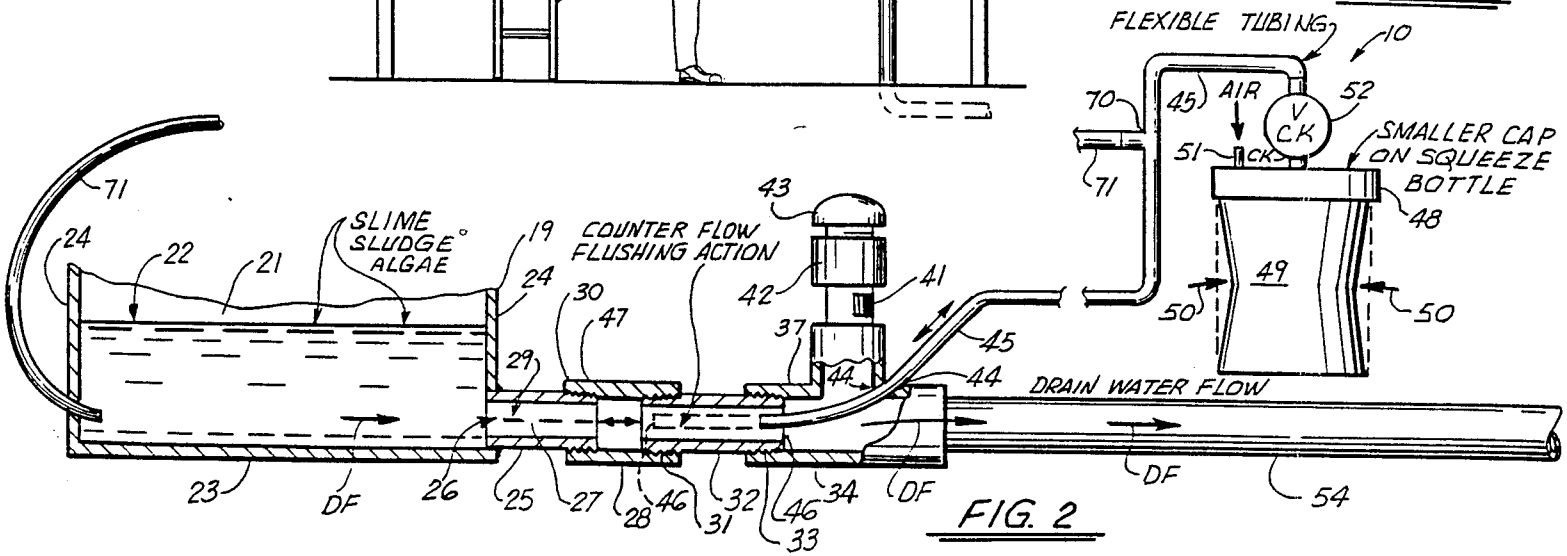
FIG. 2 is an enlarged fragmentary view of the preferred embodiment of the apparatus of the present invention.

FIGS. 1–2 illustrate the preferred embodiment of the apparatus of the present invention designated generally by the numeral 10. In FIG. 1 there can be seen a schematic representation of a home 11 having roof 12, attic 13, and living areas 14. An attic access doorway 15 can be provided with a ladder or stair for entering and opening 17 into the attic. The home 11 also provides a plumbing drain or vent stack 18.

An air conditioning unit 19 is schematically illustrated as having a base 20 and a reservoir or drain pan 21 portion. Water typically accumulates within the reservoir 21 during normal operation of the unit because of condensation. A water surface 22 is illustrated as well as the bottom 23 of reservoir or drain pan 21 outer sidewalls 24.

Drain line 25 communicates with opening 26 in reservoir 21. Drain line 25 provides an internal fluid conveying bore 27. Pipe coupling 28 also includes a coupling bore 29 and can have, for example, threaded end connection 30, 31 for attaching coupling 28 respectively to drain line 25 and pipe joint 32. Housing 34 provides a fitting which allows the drain line 25 and opening 26 to be maintained in an open position with simple periodic use.

Housing 34 includes a sidewall 35 and a longitudinal bore 36 which generally aligns with the bore 27 of drain line 25 as well as the bore 29 of coupling 28. Housing 34 includes threaded end portions 37, 38 as well as a lateral upwardly extending bore 39.

Sidewall 40 defines the lateral upwardly extending bore 39 so that housing 34 has a general T-shape both externally and internally in the preferred embodiment.

Pipe joint 41 connects to housing 34 at bore 39. Coupling 42 attaches to joint 41 and inspection cover 43 forms a closure which can be removed so that access to bore 36 can be obtained via joint 41 and bore 39.

Housing 34 also includes a diagonal opening 44 which has a preferably twenty to seventy-five degree (20°–75°) angular orientation with respect to the longitudinal axis of bore 36 of housing 34. A flexible conduit tube 45 having a tube lumen includes a distal end portion 46 which can be moved through the respective longitudinal bores 29 and 27 of coupling 28 and drain line 25. Housing 34 could be a harder material than conduit 45. For example, housing 34 could be steel, or hard rigid plastic, while conduit 45 could be a soft plastic such as polypropylene, or of rubber. Thus the fit between flexible conduit 45 and diagonal opening 44 would be a snug water tight fit but would not prevent sliding movement of conduit 45 with respect to opening 44 so that the distal end 46 of conduit 45 can be moved toward drain opening 26 as shown by the phantom lines in FIG. 2. The conduit 45 would be of an equal or slightly larger external diameter than the internal diameter of opening 44 so that a slight deformation of the conduit cross section at opening 44 creates an interference fit between conduit 45 and housing 34 at opening 44.

The distal end 46 could be left within the bore 29 of coupling 28 for example but thrust forwardly toward opening 26 in the event that reservoir 21 became clogged at opening 26. Arrow 47 in FIG. 2 illustrates that the distal end 46 of flexible conduit 45 could be moved forwardly or rearwardly between diagonal opening 44 and reservoir 21 as desired. For routine maintenance, chemicals would be added through conduit 45 to the bore 29 of coupling 28 into the bore 27 of drain line 25.

Because of the orientation of flexible conduit 45 with respect to the typical drain flow path (arrow DF) in FIG. 2, it can be seen that chemicals can be thrust against the direction of flow using pump bottle 49 and with sufficient force to mechanically blast away sludge, algae, fungi, and other solid material which might clog opening 26. Indeed, the distal end 46 of conduit 45 could itself be thrust all the way to opening 26 and into reservoir 21 in order to dislodge any solid material blocking opening 26.

A squeezable pump-bottle container 49 would preferably include a removeable cap 48 which could be threadably attached to container 49. Arrows 50 in FIG. 2 indicate that container 49 could be squeezed generating internal pressure which would force chemical such as a biocide through conduit 45 and into the bore 36 of housing 34 as well as into the bore 29 of coupling 28 and the bore 27 of drain line 25. Thus, a combination of mechanical and chemical action is provided for maintaining the drain line 25 and the opening 26 in an open flow situation if such is performed on a routing basis such as monthly. Air inlet 51 allows air to vent into container 49 through top 48 to replenish air thereto after the container is squeezed. Check valve 52 however prevents dispensed fluid contained in conduit 45 from returning to container 49. Thus when the container is squeezed, fluid will flow through conduit 45 as desired into bore 36. After biocides or other suitable chemicals are injected into the bores 36, 29, 27, the solid material which is mechanically and chemically dislodged will then drain, as shown in by the drain flow arrows DF in FIG. 2, through line 54 to a plumbing drain line to which it connects at 55. It should be understood, that the container 49 could be left permanently in the attic area 13 or closet area of the home so that the owner could use the attic stairway 16 in order to activate the container, on a routine basis such as once a month. However, as also shown in FIG. 2, an elongated conduit 45 (for example 12–15 feet in length) could be used so that the homeowner 60 could actually inject chemical from the living area 14 of the home without having to enter the attic. Thus, the container could be kept in the living area 14 of the home in a closet for example.

Figure 3:
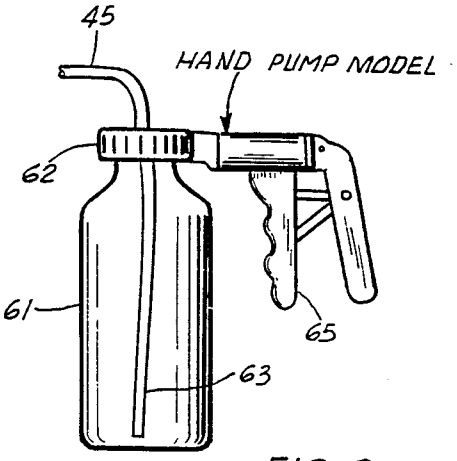
FIG. 3 is a fragmentary view of the preferred embodiment of the apparatus of the present invention.

In FIG. 3, a alternate version of the container 49 is shown which would use a container body 61 with a removeable top 62 and a hand pump 65, which is commercially available, for pumping biocides or like chemicals through suction line 63 to conduit 45.

If desired, a tee connection can be used to pump fluid through line 45 directly to the reservoir 21 but upstream of drain line 25 and opening 26. Thus, Tee 70 would be connected to a branch line 71 which would enter the reservoir 21 far upstream of drain opening 26. In this fashion, biocides would be added to both sides of the reservoir so that routine maintenance would occur every time the bottle was squeezed, preferably once or twice a month. By varying the diameters of the branch line and the main flexible conduit 45, the quantities of flow could be desireably controlled.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An air conditioner drain line and drain pan cleaner kit apparatus comprising:

(a) a drain outlet structure for draining accumulated fluid from the pan of an air conditioner and including a drain flow line with a drain line bore for transmitting such fluid to a desired remote discharge point;

(b) the drain outlet structure including a fitting body positioned during use in the drain flow line and adjacent the air conditioner drain pan, the fitting having a fitting bore communicating with the drain line bore;

(c) fitting port extending both externally and internally of the fitting body, communicating with the flow bore;

(d) a flexible flush line conduit comprising an elongated tubular member with a tube lumen for conveying flow, and connected during use to the fitting port extending therethrough, the tubular member having an external diameter equal to or smaller than the internal diameter of the drain line bore and equal to or larger than the fitting port;

(e) the flush line conduit forming a slideable connection with the fitting port and a seal therewith so that excessive fluid will not leak from the fitting port during use, and the flush line defines an acute angle with the drain line bore axis at the fitting outlet;

(f) the flush line being extendable between the fitting and a position at least adjacent the drain outlet so that the flush line or fluid dispensed therefrom can mechanically break up solid material clogging the drain outlet structure;

(g) pump means containing fluid for pumping a cleaning fluid into the flush line lumen and drain line bore.

2. The apparatus of claim 1 wherein the manually operable pump means includes a squeeze bottle.

3. The apparatus of claim 1 wherein the manually operable pump means includes a lever operable manual pump.

4. The apparatus of claim 1 wherein flush line is a flexible conduit with a collapsible wall.

5. The apparatus of claim 4 wherein the flush line is a plastic material with a collapsible wall.

6. The apparatus of claim 1 wherein the fitting includes a lateral opening defining a clean out for accessing the fitting bore.

7. The apparatus of claim 6 wherein the fitting body is generally tee shaped.

8. The apparatus of claim 1 wherein the fitting outlet defines an angle of between twenty and seventy-five degrees (15°–75°) with the fitting bore longitudinal axis.

9. The apparatus of claim 1 further comprising a second flush line, communicating with the first flush line upstream of the fitting body and by-passing the outlet structure for dispensing cleaning fluid to the drain pan at a position in the drain pan upstream of the outlet structure.

10. The apparatus of claim 1 wherein fitting body is a tee, and the outlet is positioned between a laterally extending leg of the tee and a longitudinally extending leg of the tee.

* * * * *